US005979281A

United States Patent [19]

Caesar

[11] Patent Number: 5,979,281

[45] Date of Patent: Nov. 9, 1999

[54] PRODUCE SLICER AND CHOPPER DEVICE

[76] Inventor: Wayne W Caesar, 1010 43rd St., apt. 1R, Brooklyn, N.Y. 11219

[21] Appl. No.: 09/027,666

[22] Filed: Feb. 23, 1998

[51] Int. Cl.[6] ..... B26D 1/09; B26D 7/00

[52] U.S. Cl. ..... 83/167; 83/437.5; 83/520; 83/563; 83/619; 83/648; 83/821; 83/932; 30/305

[58] Field of Search ..... 83/167, 648, 932, 83/437.5, 468.7, 520, 521, 619, 821, 618, 563, 761, 564, 620; 30/305

[56] References Cited

U.S. PATENT DOCUMENTS

| | | | |
|---|---|---|---|
| D. 311,305 | 10/1990 | Melamenchuk et al. . | |
| 812,439 | 2/1906 | Murphy | 83/167 |
| 1,012,615 | 12/1911 | Dorr | 83/167 |
| 1,255,550 | 2/1918 | Murphy | 83/437.5 |
| 1,474,767 | 11/1923 | Du Buque | 83/564 X |
| 1,583,725 | 5/1926 | Lowry | 83/648 X |
| 1,672,045 | 6/1928 | Sweeney | 30/305 |
| 1,768,580 | 7/1930 | Dischert | 83/167 X |
| 1,848,642 | 3/1932 | Micheli | 83/618 X |
| 2,130,646 | 9/1938 | Janke | 83/437.5 X |
| 2,303,880 | 12/1942 | Hilton et al. | 83/520 X |
| 2,621,691 | 12/1952 | Brualdi | 83/563 X |
| 2,661,039 | 12/1953 | Davis et al. | 83/167 X |
| 2,790,474 | 4/1957 | Norton, Sr. | 83/932 X |
| 3,520,220 | 7/1970 | Acker | 83/620 X |
| 4,056,026 | 11/1977 | Panaritis et al. | 83/454 |
| 4,567,801 | 2/1986 | Jones . | |
| 4,624,166 | 11/1986 | Kreth . | |
| 4,625,607 | 12/1986 | Maillez . | |
| 5,142,973 | 9/1992 | Tur et al. . | |
| 5,181,665 | 1/1993 | Flisram . | |
| 5,456,010 | 10/1995 | Bryda | 30/305 X |

*Primary Examiner*—Rinaldi I. Rada
*Assistant Examiner*—Charles Goodman
*Attorney, Agent, or Firm*—Michael I. Kroll

[57] ABSTRACT

A produce slicer and chopper device (10) comprising a housing (12) having a large compartment (14) and a small compartment (16) in a side by side relationship. A first blade assembly (18) is mounted onto a top of the housing (12) to be manually operated to extend down into the large compartment (14), so as to vertically slice and chop vegetables, fruit and cheeses placed within the large compartment (14). A second blade assembly (20) is mounted onto the top of the housing (12) to be manually operated to extend down into the small compartment (16), so as to vertically slice and chop vegetables, fruit and cheeses placed within the small compartment (16). A third blade assembly (22) is mounted onto a side of the housing (12) to be manually operated to extend sideways into the large compartment (14), so as to horizontally slice and chop vegetables, fruit and cheeses placed within the large compartment (14), when the first blade assembly (18) is in an outwardly extended position.

20 Claims, 6 Drawing Sheets

PRODUCE SLICER AND CHOPPER DEVICE

BACKGROUND OF THE INVENTION

1. Field of the Invention

The instant invention relates generally to food slicers and more specifically it relates to a produce slicer and chopper device. The produce slicer and chopper device is a kitchen tool which will allow a person to quickly and neatly slice and chop vegetables, fruits and cheeses in a multitude of different ways, while saving a considerable amount of time and effort. The sliced and chopped vegetables, fruits and cheeses are conveniently collected within storage compartments. The appealing features of the device are its efficiency, convenience, durability, safety, novelty and ease of use.

2. Description of the Prior Art

Numerous food slicers have been provided in prior art. For example, U.S. Pat. Nos. 4,567,801 to Jones; 4,624,166 to Kreth et al.; 4,625,607 to Maillez; 5,142,973 to Tur et al.; 5,181,665 to Flisram and D. 311,305 to Melamenchuck et al. all are illustrative of such prior art. While these units may be suitable for the particular purpose to which they address, they would not be as suitable for the purposes of the present invention as heretofore described.

JONES, FRANK W.

SLICING DEVICE FOR ROUNDED FOOD ARTICLES

U.S. Pat. No. 4,567,801

A rounded food article, such as an onion, is quickly sliced into a number of slices by a manual device with a plurality of racks of parallel spaced tensioned blades mounted to the base at an acute angle. A transversing carrier assembly slides along guide rods in the base and is actuated by a pusher handle pivotally mounted to the base and pusher bar pivotally mounted to the pusher handle and the carrier assembly. The carrier assembly has a carrier plate and carrier fingers which are a parallel array of planer segments mounted above and parallel with the carrier plate and intermesh with the plurality of racks of blades. The food article is placed on the carrier plate and forced through the racks of blades by the carrier fingers, thereby slicing the onion into a number of slices. A guard mounted on the base shields the sharp edges of the blades. With the carrier in the open position the rack of blades in combination with the carrier fingers and guard creates a vertical cavity in which the food article to be sliced is inserted.

KRETH, JULIUS

SCHREIBER, ALFONS

STEINKO, WILLI

KITCHEN SLICER HAVING AN ADJUSTABLE KNIFE

U.S. Pat. No. 4,624,166

A kitchen or domestic food slicer having a flat bed surface over which the food is moved and a knife mounted essentially across that surface. The knife alone being pivotably mounted such that its sharp leading edge can be raised or lowered relative the bed surface to vary the thickness of cut. The pivoting of the knife is achieved by cam surfaces on a pair of bars one positioned either side of the bed surface, the bars being slideable lengthwise by a rotatable knob and the cam surfaces including inclined portions to cause pivoting of the knife as the bars slide longitudinally.

MAILLEZ, PAUL

FOOD SLICER

U.S. Pat. No. 4,625,607

A machine for slicing a piece of a foodstuff has a base having front and rear ends and provided with at least one guide extending longitudinally therebetween, a carriage longitudinally displaceable along the guide on the base and formed with a seat adapted to receive the foodstuff piece and with a plurality of longitudinally extending and upwardly open slots at the seat, and a blade frame pivotal about a horizontal transverse axis at the rear end of the base and provided with a plurality of blades extending radially of the axis. This frame is pivotal between an upper position with the blades extending upward clear of the carriage from the axis and a lower position with the blades extending horizontally longitudinally and received in the slots. A link is connected between the carriage and the blade frame for displacing the carriage longitudinally from the rear base end to the front base end on displacement of the blade frame from the upper to the lower position and vice versa.

TUR, ANTON

REPISKY, MILAN

PROIA, NICHOLAS M.

ONION CUTTER

U.S. Pat. No. 5,142,973

A food cutting apparatus for making multiple radial cuts in a work piece such as an onion has a cutter assembly formed as a truncated cone by a plurality of radially extending cutter blades. The cutter assembly cuts through the work piece until it encounters stops which prevent it from passing completely through the work piece. Ejector members are provided for separating the cutter assembly from the work piece after the cutting operation.

FILSRAM, DENNIS G.

FOOD SLICING WITH MULTIPLE CUTTING SURFACE BLADE

U.S. Pat. No. 5,181,665

An apparatus and method are provided for slicing food product sticks such as loaves or chubs or the like of meat and cheese. A blade assembly is utilized which includes a plurality of, typically two, blade members, each of which has a curved cutting surface that terminates at a trailing tip. A non-slicing mode is achieved by having the blade assembly exhibit a substantial gap between the trailing tip of one blade member and the curved cutting surface leading edge of another blade member. The apparatus and method are particularly well suited for enhancing the throughput of a food processing line and for improving the quality of sliced products processed therethrough.

MELAMENCHUCK, GAL INA

ARATO, PAUL T.

COFFMAN, F. WILLIAM

FOOD SLICER

U.S. Pat. No. D. 311,305

The ornamental design for a food slicer, as shown and described.

Figure 1:
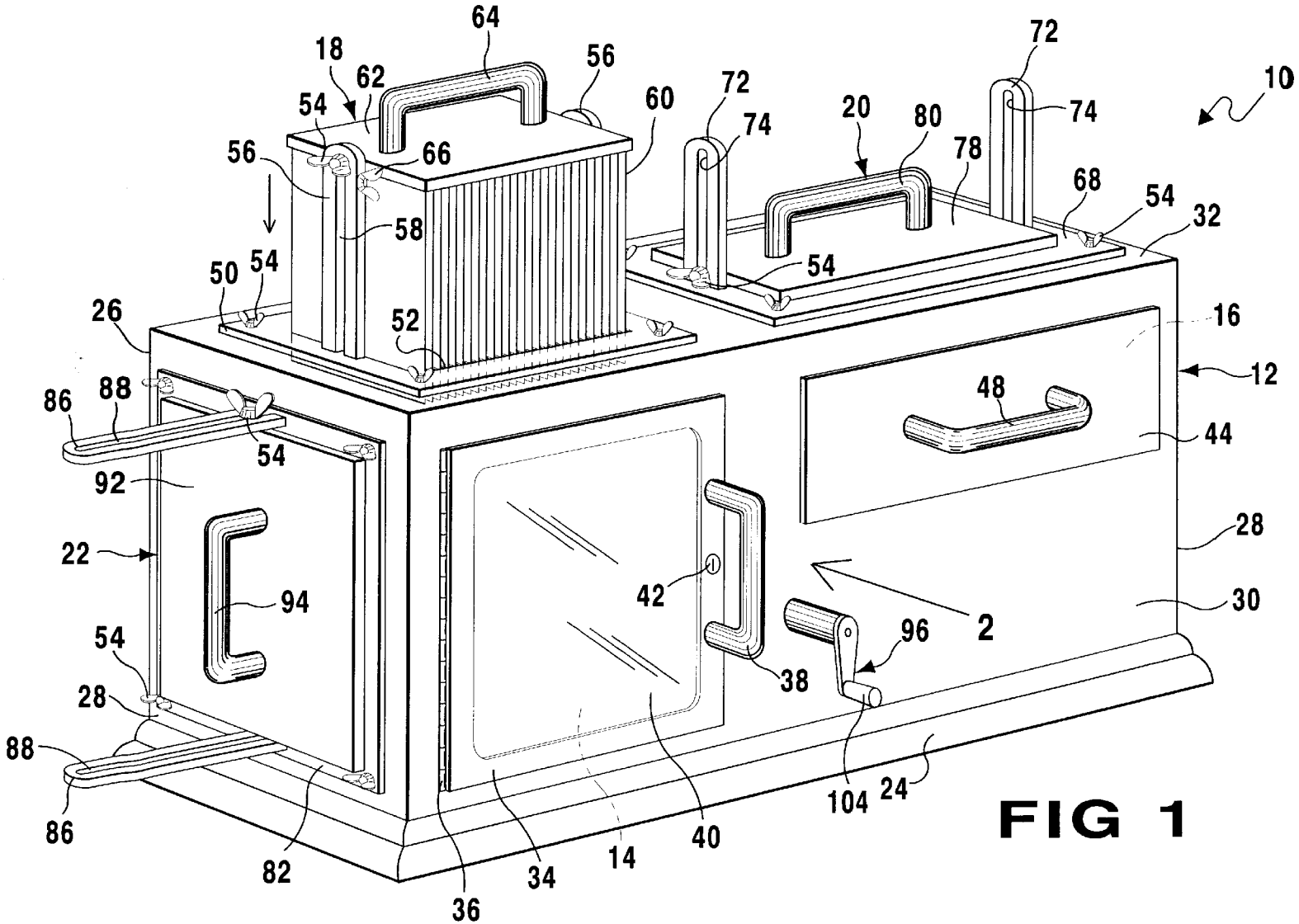
FIG. 1 is a rear perspective view of a food slicer showing the new design.

The undisclosed bottom view is plane and unornamented.

SUMMARY OF THE INVENTION

A primary object of the present invention is to provide a produce slicer and chopper device that will overcome the shortcomings of the prior art devices.

Another object is to provide a produce slicer and chopper device that is a kitchen tool which will allow a person to quickly and neatly slice and chop vegetables, fruits and cheeses in a multitude of different ways, while saving a considerable amount of time and effort.

An additional object is to provide a produce slicer and chopper device in which the sliced and chopped vegetables, fruits and cheeses are conveniently collected within storage compartments, so that the appealing features of the device are its efficiency, convenience, durability, safety, novelty and ease of use.

A further object is to provide a produce slicer and chopper device that is simple and easy to use.

A still further object is to provide a produce slicer and chopper device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 1 is a perspective view of the present invention with the large compartment top blade assembly in an outwardly extended position.

Figure 2:
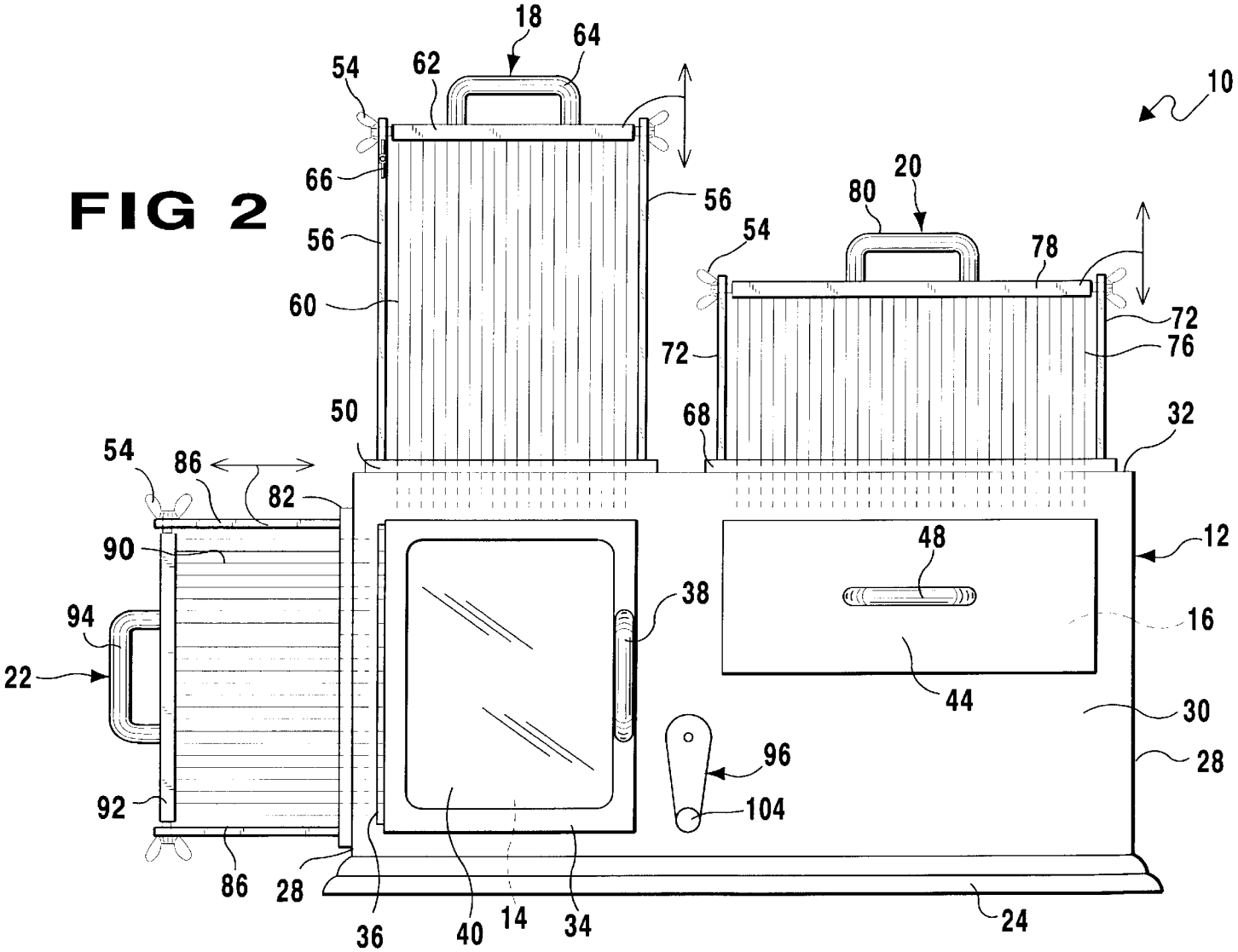
FIG. 2 is a front perspective view thereof.

FIG. 2 is a front elevational view taken in the direction of arrow 2 in FIG. 1, with all of the blade assemblies in their outwardly extended positions.

Figure 3:
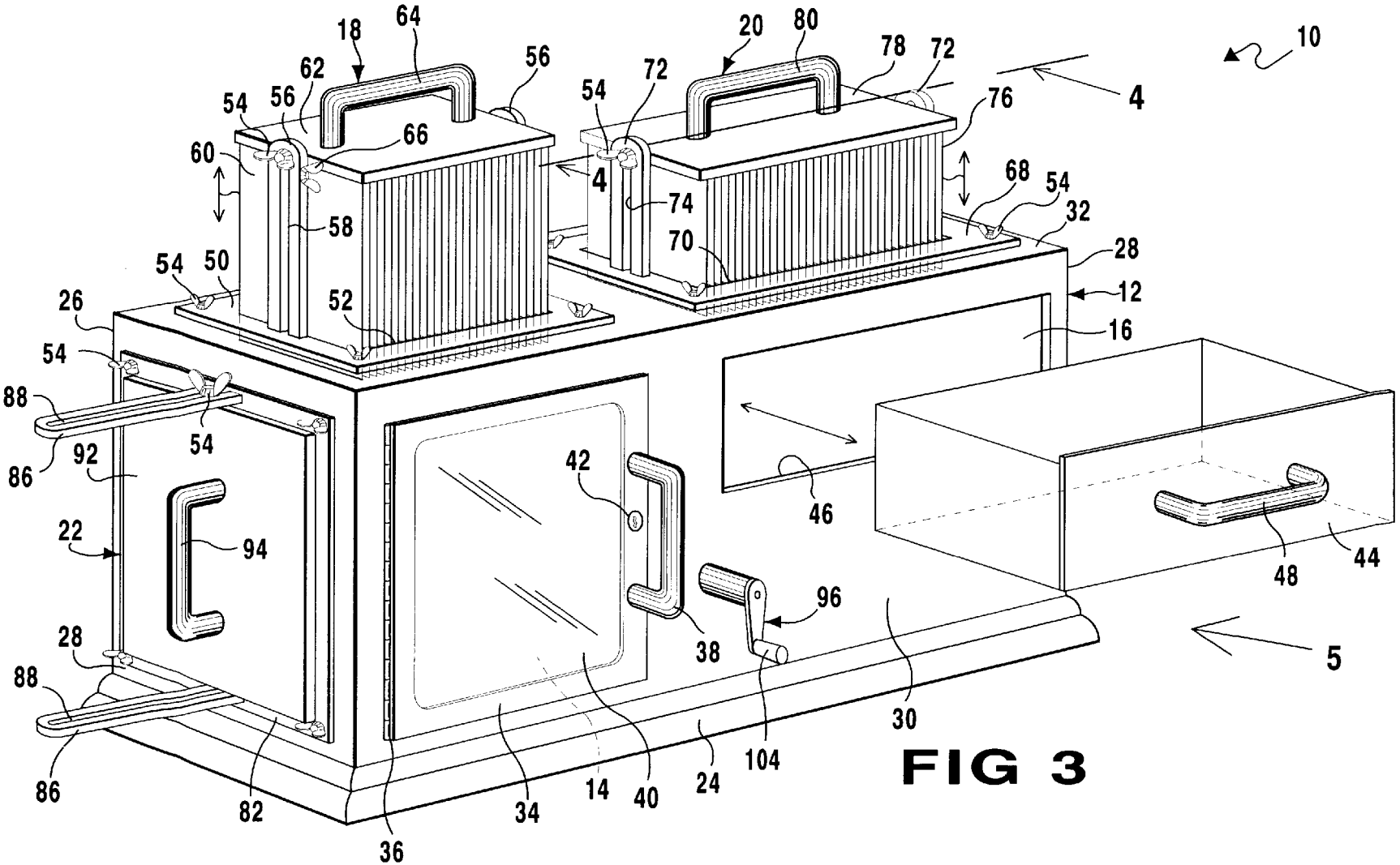
FIG. 3 is a front elevational view thereof.

FIG. 3 is a perspective view similar to FIG. 1, showing the two top blade assemblies in their outwardly extended positions and the small compartment storage drawer exploded therefrom.

Figure 4:
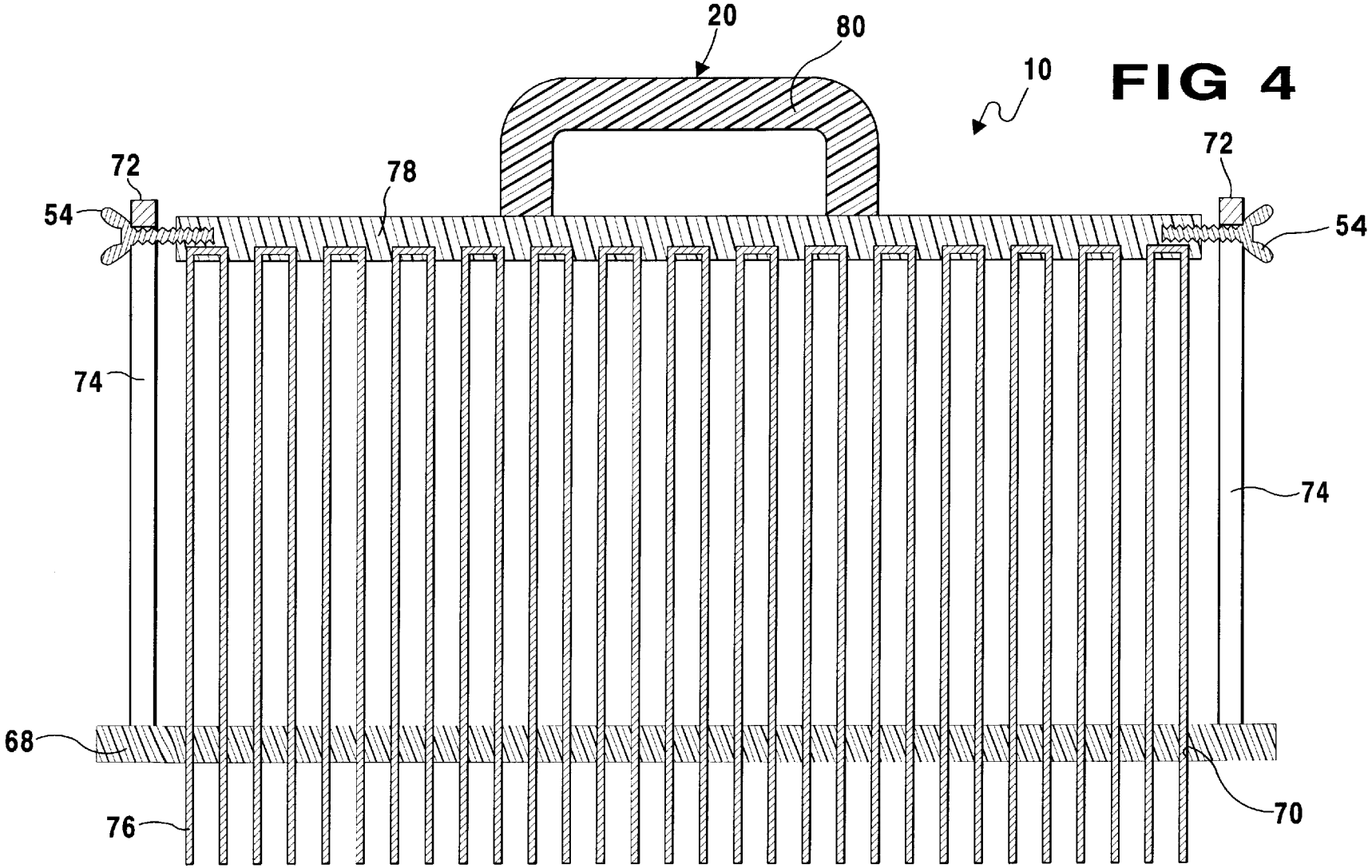
FIG. 4 is a left side elevational view thereof.

FIG. 4 is an enlarged cross sectional view taken along line 4—4 in FIG. 3 of the small compartment blade assembly.

Figure 5:
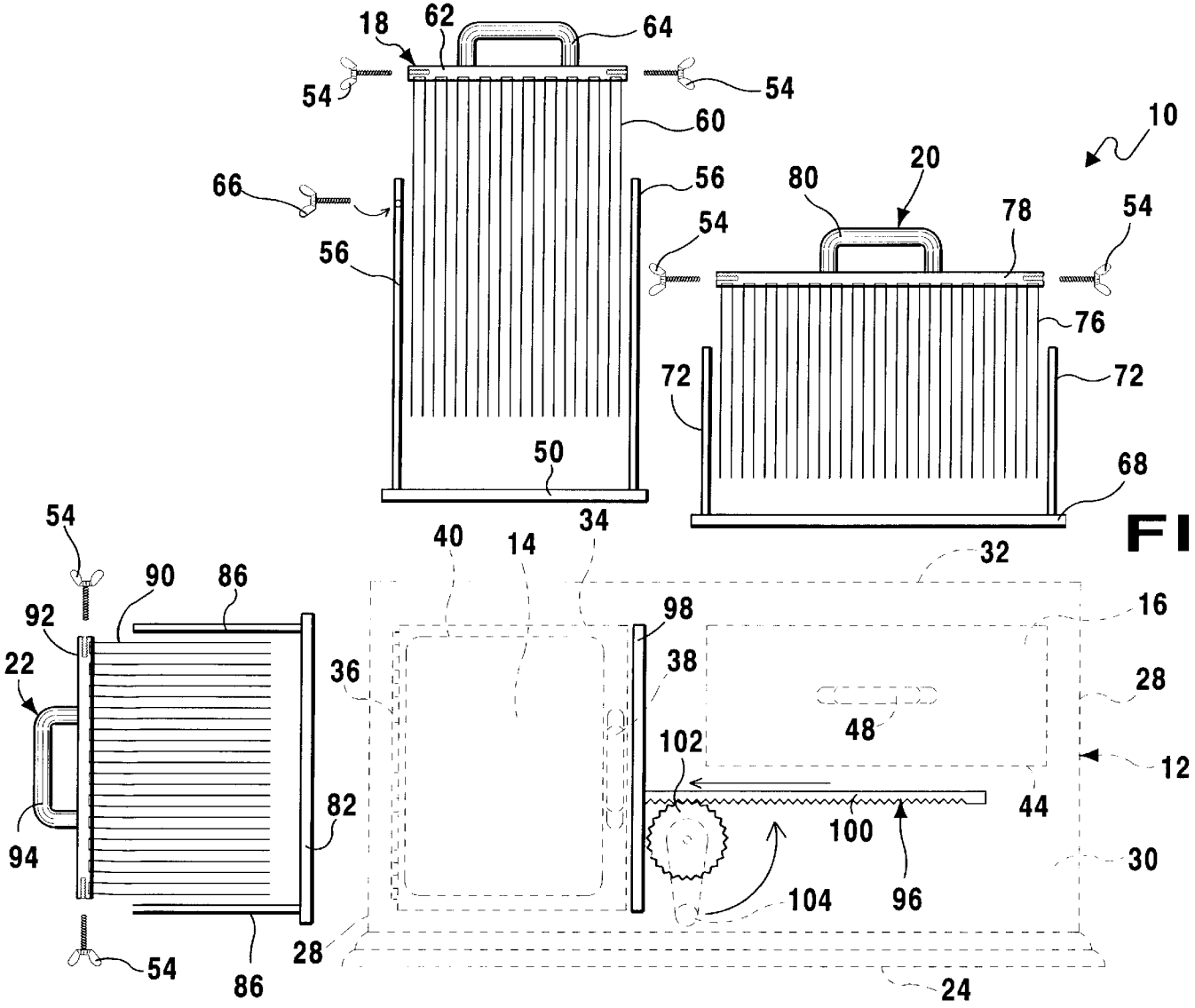

FIG. 5 is an exploded front elevational view taken in the direction of arrow 5 in FIG. 3, with the housing and small compartment storage drawer shown in phantom.

Figure 6:
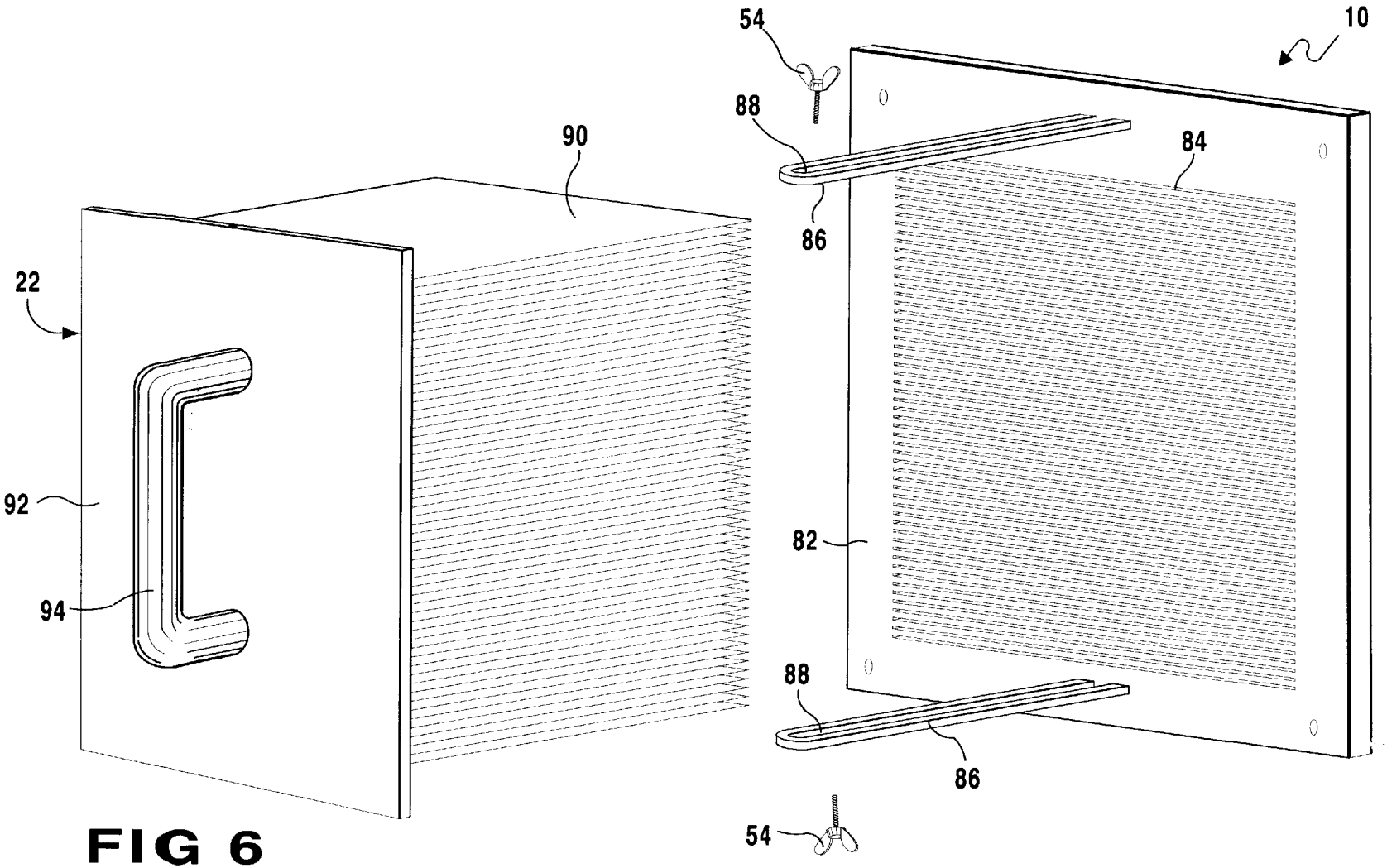

FIG. 6 is an exploded perspective view of the side blade assembly.

Similar reference characters denote corresponding features consistently throughout the attached drawings.

DESCRIPTION OF THE PREFERRED EMBODIMENTS

Turning now descriptively to the drawings, in which similar reference characters denote similar elements throughout the several views, FIGS. 1 through 6 illustrate the present invention being a produce slicer and chopper device 10. With regard to the reference numerals used, the following numbering is used throughout the various drawing

10 produce slicer and chopper device 10
12 housing of 10
14 large compartment in 12
16 small compartment in 12
18 first blade assembly of 10
20 second blade assembly of 10
22 third blade assembly of 10
24 base of 12
26 rear wall of 12
28 side wall of 12
30 front wall of 12
32 top wall of 12
34 door of 12
36 hinge between 30 and 34
38 handle on 34
40 window in 34
42 lock mechanism in 34
44 drawer of 12
46 opening in 30
48 handle on 44
50 mounting plate of 18
52 slot in 50
54 thumbscrew
56 guide rail of 18
58 slot in 56
60 blade of 18
62 blade holder plate of 18
64 operating handle on 62
66 locking thumbscrew in 56
68 mounting plate of 20
70 slot in 68
72 guide rail of 20
74 slot in 72
76 blade of 20
78 blade holder plate of 20
80 operating handle on 78
82 mounting plate of 22
84 slot in 82
86 guide rail of 22
88 slot in 86
90 blade of 22
92 blade holder plate of 22
94 operating handle on 92
96 adjusting apparatus in 12
98 movable vertical partition of 96
100 horizontal rack of 96
102 pinion of 96
104 crank handle of 96

The produce slicer and chopper device 10 comprises a having a large compartment 14 and a small compartment 16 in a side by side relationship. A first blade assembly 18 is mounted onto a top of the housing 12 to be manually operated to extend down into the large compartment 14, so as to vertically slice and chop vegetables, fruit and cheese placed within the large compartment 14. A second blade assembly 20 is mounted onto the top of the housing 12 operated to extend down into the small compartment 16, so as to vertically slice and chop vegetables, fruit and cheeses placed within the small compartment 16. A third blade assembly 22 is mounted onto a side of the housing 12 to be manually operated to extend sideways into the large compartment 14, so as to horizontally slice and chop vegetables, fruit and cheeses placed within the large compartment 14, when the first blade assembly 18 is in an outwardly extended position.

The housing 12 includes a base 24. A rear wall 26 extends upwardly from the base 24. A pair of side walls 28 extend upwardly from the base 24. A front wall 30 extends upwardly from the base 24. A top wall 32 extends across the rear wall 26, the side walls 28 and the front wall 30, thereby forming the large compartment 14 and the small compartment 16 therein.

The housing 12 also includes a door 34 hinged at 36 to the front wall 30 at the large compartment 14. A handle 38 is mounted on the door, so that the door 34 can be opened to gain access into the large compartment 14, to remove and replace the vegetables, fruits and cheeses.

The door 34 contains a window 40, so that a person can see into the large compartment 14. The door 34 also contains a lock mechanism 42 to keep the door 34 locked. A drawer 44 is inserted in a sliding manner within an opening 46 in the front wall 30 at the small compartment 16. A handle 48 is mounted on the drawer 44, so that the drawer 44 can be pulled out to remove and replace the vegetables, fruits and cheeses.

The first blade assembly 18 comprises a mounting plate 50 having a plurality of spaced apart parallel slots 52 therethrough. A plurality of thumbscrews 54 are for attaching the mounting plate 50 over an aperture in the top wall 32 of the housing 12 above the large compartment 14. A pair of guide rails 56 are spaced apart and extend upwardly on the mounting plate 50. Each guide rail 56 has a slot 58. A plurality of blades 60 are provided. A blade holder plate 62 is for retaining in spaced apart parallel relationships the blades 60. The blade holder 62 has an operating handle 64. A pair of thumbscrews 54 are each threading into an opposite side of the blade holder plate 62 to ride in the slots 58 of the guide rails 56. The blades 60 will extend vertically through the slots 52 in the mounting plate 50 and into the large compartment 14 in the housing 12. A locking thumbscrew 66 threads transversely through one of the guide rails 56 at an upper end of the slot 58, so as to keep the first blade assembly 18 locked in its outwardly extended position.

The second blade assembly 20 contains a mounting plate 68 having a plurality of spaced apart parallel slots 70 therethrough. A plurality of thumbscrews 54 are for attaching the mounting plate 68 over an aperture in the top wall 32 of the housing 12 above the small compartment 16. A pair of guide rails 72 are spaced apart and extend upwardly on the mounting plate 68. Each guide rail 72 has a slot 74. A plurality of blades 76 are provided. A blade holder plate 78 is for retaining in spaced apart parallel relationships the blades 76. The blade holder plate 78 has an operating handle 80. A pair of thumbscrews 54 are each threaded into an opposite side of the blade holder plate 78 to ride in the slots 74 of the guide rails 72. The blades 76 will extend vertically through the slots 70 in the mounting plate 68 and into the small compartment 16 in the housing 12.

The third blade assembly 22 includes a mounting plate 82, having a plurality of spaced apart parallel slots 84 therethrough. A plurality of thumbscrews 54 are for attaching the mounting plate 82 over an aperture in the side wall 28 of the housing 12 adjacent the large compartment 14. A pair of guide rails 86 are spaced apart and extend outwardly on the mounting plate 82. Each guide rail 86 has a slot 88. A plurality of blades 90 are provided. A blade holder plate 92 is for retaining in spaced apart parallel relationships the blades 90. The blade holder plate 92 has an operating handle 94. A pair of thumbscrews 54 are each threaded into an opposite side of the blade holder plate 92 to ride in the slots 88 of the guide rails 86. The blades 90 will extend horizontally through the slots 84 in the mounting plate 82 and into the large compartment 14 in the housing 12. The housing 12 includes an apparatus 96 for adjusting the width of the large compartment 14.

The adjusting apparatus 96, as best seen in FIG. 5, consists of a movable vertical partition 98 carried within the housing 12 adjacent the large compartment 14 opposite from the third blade assembly 22. A horizontal rack 100 is affixed at one end to the movable vertical partition 98 and is carried within the housing 12. A pinion 102 is carried within the housing 12. The pinion 102 is in engagement with the horizontal rack 100. A crank handle 104 is on an outer surface of the front wall 30 of the housing 12 and is connected to the pinion 102 in an operable manner. When the crank handle 104 is manually rotated, the pinion 102 will rotate and cause the horizontal rack 100 to go into a reciprocating motion, to move the movable vertical partition 98 to the left and to the right to decrease and increase the width of the large compartment 14 within the housing 12.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A produce slicer and chopper device comprising:

a) a housing having a large compartment and a small compartment in a side by side relationship;

b) a first blade assembly mounted onto a top of said housing to be manually operated to extend down into said large compartment, so as to vertically slice and chop vegetables, fruit and cheeses placed within said large compartment;

c) a second blade assembly mounted onto the top of said housing to be manually operated to extend down into said small compartment, so as to vertically slice and chop vegetables, fruit and cheeses placed within said small compartment; and d) a third blade assembly mounted onto a side of said housing to be manually operated to extend sideways into said large compartment, so as to horizontally slice and chop vegetables, fruit and cheeses placed within said large compartment, when said first blade assembly is in an outwardly extended position.

2. A produce slicer and chopper device as recited in claim 1, wherein said housing includes:

a) a base;

b) a rear wall extending upwardly from said base;

c) a pair of side walls extending upwardly from said base;

d) a front wall extending upwardly from said base; and e) a top wall extending across said rear wall, said side walls and said front wall, thereby forming the large compartment and the small compartment therein.

3. A produce slicer and chopper device as recited in claim 2, wherein said housing includes:

a) a door hinged to said front wall at said large compartment; and b) a handle mounted on said door, so that said door can be opened to gain access into said large compartment, to remove and replace the vegetables, fruits and cheeses.

4. A produce slicer and chopper device as recited in claim 3, wherein said door includes a window, so that a person can see into said large compartment.

5. A produce slicer and chopper device as recited in claim 3, wherein said door includes a lock mechanism to keep said door locked.

6. A produce slicer and chopper device as recited in claim 2, wherein said housing includes:

a) a drawer inserted in a sliding manner within said front wall at said small compartment; and b) a handle mounted on said drawer, so that said drawer can be pulled out to remove and replace the vegetables, fruits and cheeses.

7. A produce slicer and chopper device as recited in claim 2, wherein said first blade assembly includes:

a) a mounting plate having a plurality of spaced apart parallel slots therethrough;

b) a plurality of thumbscrews for attaching said mounting plate over an aperture in said top wall of said housing above said large compartment;

c) a pair of guide rails spaced apart and extending upwardly on said mounting plate, each said guide rail having a slot;

d) a plurality of blades;

e) a blade holder plate for retaining in spaced apart parallel relationships said blades, said blade holder plate having an operating handle;

f) a pair of thumbscrews each threaded into an opposite side of said blade holder plate to ride in said slots of said guide rails, so that said blades will extend vertically through said slots in said mounting plate and into said large compartment in said housing; and g) a locking thumbscrew threaded transversely through one of said guide rails at an upper end of said slot of said one of said guide rails, so as to keep said first blade assembly locked in said outwardly extended position.

8. A produce slicer and chopper device as recited in claim 2, wherein said second blade assembly includes:

a) a mounting plate having a plurality of spaced apart parallel slots therethrough;

b) a plurality of thumbscrews for attaching said mounting plate over an aperture in said top wall of said housing above said small compartment;

c) a pair of guide rails spaced apart and extending upwardly on said mounting plate, each said guide rail having a slot;

d) a plurality of blades;

e) a blade holder plate for retaining in spaced apart parallel relationships said blades, said blade holder plate having an operating handle; and f) a pair of thumbscrews each threaded into an opposite side of said blade holder plate to ride in said slots of said guide rails, so that said blades will extend vertically through said slots in said mounting plate and into said small compartment in said housing.

9. A produce slicer and chopper device as recited in claim 2, wherein said third blade assembly includes:

a) a mounting plate having a plurality of spaced apart parallel slots therethrough;

b) a plurality of thumbscrews for attaching said mounting plate over an aperture in one of said side walls of said housing adjacent said large compartment;

c) a pair of guide rails spaced apart and extending outwardly on said mounting plate, each said guide rail having a slot;

d) a plurality of blades;

e) a blade holder plate for retaining in spaced apart parallel relationships said blades, said blade holder plate having an operating handle; and f) a pair of thumbscrews each threaded into an opposite side of said blade holder plate to ride in said slots of said guide rails, so that said blades will extend horizontally through said slots in said mounting plate and into said large compartment in said housing.

10. A produce slicer and chopper device as recited in claim 2, wherein said housing includes means for adjusting a width of said large compartment.

11. A produce slicer and chopper device as recited in claim 10, wherein said adjusting means includes:

a) a movable vertical partition carried within said housing adjacent said large compartment opposite from said third blade assembly;

b) a horizontal rack affixed at one end to said movable vertical partition and carried within said housing;

c) a pinion carried within said housing, said pinion in engagement with said horizontal rack; and d) a crank handle on an outer surface of said front wall of said housing and connected to said pinion in an operable manner, so that when said crank handle is manually rotated said pinion will rotate and cause said horizontal rack to go into a reciprocating motion, to move said movable vertical partition left and right to decrease and increase the width of said large compartment within said housing.

12. A produce slicer and chopper device comprising:

a) a housing having a large compartment and a small compartment in a side by side relationship, wherein said housing includes a base, a rear wall extending upwardly from said base, a pair of side walls extending upwardly from said base, a front wall extending upwardly from said base and a top wall extending across said rear wall, said side walls and said front wall, thereby forming the large compartment and the small compartment therein;

b) a first blade assembly mounted onto a top of said housing to be manually operated to extend down into said large compartment, so as to vertically slice and chop vegetables, fruit and cheeses placed within said large compartment;

c) a second blade assembly mounted onto the top of said housing to be manually operated to extend down into said small compartment, so as to vertically slice and chop vegetables, fruit and cheeses placed within said small compartment; and d) a third blade assembly mounted onto a side of said housing to be manually operated to extend sideways into said large compartment, so as to horizontally slice and chop vegetables, fruit and cheeses placed within said large compartment, when said first blade assembly is in an outwardly extended position.

13. A produce slicer and chopper device as recited in claim 12, wherein said housing includes:

a) a door hinged to said front wall at said large compartment; and b) a handle mounted on said door, so that said door can be opened to gain access into said large compartment, to remove and replace the vegetables, fruits and cheeses.

14. A produce slicer and chopper device as recited in claim 13, wherein said door includes a window, so that a person can see into said large compartment.

15. A produce slicer and chopper device as recited in claim 14, wherein said door includes a lock mechanism to keep said door locked.

16. A produce slicer and chopper device as recited in claim 15, wherein said housing includes:

a) a drawer inserted in a sliding manner within said front wall at said small compartment; and b) a handle mounted on said drawer, so that said drawer can be pulled out to remove and replace the vegetables, fruits and cheeses.

17. A produce slicer and chopper device as recited in claim 16, wherein said first blade assembly includes:

a) a mounting plate having a plurality of spaced apart parallel slots therethrough;

b) a plurality of thumbscrews for attaching said mounting plate over an aperture in said top wall of said housing above said large compartment;

c) a pair of guide rails spaced apart and extending upwardly on said mounting plate, each said guide rail having a slot;

d) a plurality of blades;

e) a blade holder plate for retaining in spaced apart parallel relationships said blades, said blade holder plate having an operating handle;

f) a pair of thumbscrews each threaded into an opposite side of said blade holder plate to ride in said slots of said guide rails, so that said blades will extend vertically through said slots in said mounting plate and into said large compartment in said housing; and g) a locking thumbscrew threaded transversely through one of said guide rails at an upper end of said slot of said one of said guide rails, so as to keep said first blade assembly locked in said outwardly extended position.

18. A produce slicer and chopper device as recited in claim 17, wherein said second blade assembly includes:

a) a mounting plate having a plurality of spaced apart parallel slots therethrough;

b) a plurality of thumbscrews for attaching said mounting plate over an aperture in said top wall of said housing above said small compartment;

c) a pair of guide rails spaced apart and extending upwardly on said mounting plate, each said guide rail having a slot;

d) a plurality of blades;

e) a blade holder plate for retaining in spaced apart parallel relationships said blades, said blade holder plate having an operating handle; and f) a pair of thumbscrews each threaded into an opposite side of said blade holder plate to ride in said slots of said guide rails, so that said blades will extend vertically through said slots in said mounting plate and into said small compartment in said housing.

19. A produce slicer and chopper device as recited in claim 18, wherein said third blade assembly includes:

a) a mounting plate having a plurality of spaced apart parallel slots therethrough;

b) a plurality of thumbscrews for attaching said mounting plate over an aperture in one of said side walls of said housing adjacent said large compartment;

c) a pair of guide rails spaced apart and extending outwardly on said mounting plate, each said guide rail having a slot;

d) a plurality of blades;

e) a blade holder plate for retaining in spaced apart parallel relationships said blades, said blade holder plate having an operating handle; and f) a pair of thumbscrews each threaded into an opposite side of said blade holder plate to ride in said slots of said guide rails, so that said blades will extend horizontally through said slots in said mounting plate and into said large compartment in said housing.

20. A produce slicer and chopper device as recited in claim 19, wherein said housing includes means for adjusting a width of said large compartment.

* * * * *